US010729225B1

(12) United States Patent
Kilpatrick

(10) Patent No.: US 10,729,225 B1
(45) Date of Patent: Aug. 4, 2020

(54) WEARABLE HOLDER FOR PORTABLE DEVICE

(71) Applicant: Radie Denise Kilpatrick, Chicago, IL (US)

(72) Inventor: Radie Denise Kilpatrick, Chicago, IL (US)

( * ) Notice: Subject to any disclaimer, the term of this patent is extended or adjusted under 35 U.S.C. 154(b) by 0 days.

(21) Appl. No.: 16/250,136

(22) Filed: Jan. 17, 2019

(51) Int. Cl.

| | |
|---|---|
| ***A45F 3/14*** | (2006.01) |
| ***A45C 13/30*** | (2006.01) |
| ***A45C 13/10*** | (2006.01) |
| *A45C 11/00* | (2006.01) |
| *A45F 3/00* | (2006.01) |

(52) U.S. Cl.
CPC ..... *A45F 3/14* (2013.01); *A45C 13/10* (2013.01); *A45C 13/30* (2013.01); *A45C 2011/001* (2013.01); *A45C 2011/002* (2013.01); *A45C 2011/003* (2013.01); *A45C 2013/303* (2013.01); *A45F 2003/007* (2013.01); *A45F 2003/142* (2013.01); *A45F 2200/0508* (2013.01); *A45F 2200/0516* (2013.01); *A45F 2200/0525* (2013.01)

(58) Field of Classification Search
CPC ..... A45F 3/14; A45F 2003/007; A45F 2003/142; A45F 2200/0508; A45F 2200/0516; A45F 2200/0525; A45C 13/10; A45C 13/30; A45C 2011/001–003; A45C 2013/303
See application file for complete search history.

(56) References Cited

U.S. PATENT DOCUMENTS

| | | | | |
|---|---|---|---|---|
| 4,416,405 | A * | 11/1983 | Caillouet | A45F 5/00 224/257 |
| 4,802,613 | A * | 2/1989 | Tierney | A45F 5/00 224/606 |
| 5,263,618 | A * | 11/1993 | Talavera | A45F 3/14 224/148.2 |
| 5,292,042 | A * | 3/1994 | Yamaguchi | A45F 3/02 224/158 |
| 5,653,367 | A * | 8/1997 | Abramson | H04M 1/05 224/581 |
| 5,680,977 | A | 10/1997 | Burke | |
| 6,390,346 | B1 * | 5/2002 | Thomas | A45F 3/14 224/236 |
| 6,866,174 | B2 * | 3/2005 | Hiscocks | A47D 13/025 224/159 |
| 7,416,099 | B2 | 8/2008 | deLeon et al. | |
| 2008/0203127 | A1 * | 8/2008 | Castillo-Garrison | A45F 5/02 224/607 |

* cited by examiner

*Primary Examiner* — Corey N Skurdal

(57) ABSTRACT

A wearable holder adapted to enable hands-free transport and usage of a portable device, is disclosed. The wearable holder comprises a waist strap, a middle strap, a neck strap, and a receptacle. The waist strap is adapted to secure to the waist of a wearer and a neck strap adapted to loop around the neck of the wearer. The middle strap is disposed between the waist strap and the neck strap. The receptacle secured to the middle strap is configured to receive the portable device. The receptacle further comprises a plurality of pockets on an interior side of the receptacle to secure one or more personal accessories. The wearable holder is adapted to be worn on wearer's neck, wearer's wrist, wearer's waist or wearer's body.

14 Claims, 5 Drawing Sheets

WEARABLE HOLDER FOR PORTABLE DEVICE

BACKGROUND OF THE INVENTION

1. Field of the Invention

The present disclosure relates to an accessory of a portable device. More particularly, the present disclosure relates to a wearable holder configured to enable hands-free transport of a portable device.

2. Description of the Related Art

Generally, holders for electronic devices such as mobile phones were used for safe and convenience handling by a user. However, existing holders such as belt clip type are prone to breakage, and holds the device in an attitude uncomfortable to the wearer or user, for example, in horizontal attitude. This attitude forces the wearer to reposition or remove the device. Further, removal of the device from the belt can be difficult in this attitude. To provide better protection for the device, these holders were fabricated by using relatively hard 20 material, which also causes discomfort to the users.

Several devices have been designed in the past. None of them, however, include a wearable holder that is capable of addressing the foregoing discussed issues.

Applicant believes that a related reference corresponds to U.S. Pat. No. 7,416,099B2 filed by Rodolpho deLeon et al. describes a neck strap for mobile electronic device. The Rodolpho reference discloses a neck strap for a mobile electronic device, includes a flexible loop arrangeable around the neck of a user and a connector, whereby said flexible loop is connectable to said mobile electronic device. Furthermore, one section of said flexible loop includes at least one securing element, whereby a cable is securable to said at least one section of the flexible loop. In this way, a cable, such as an earphone cable, may be secured to the flexible loop, thereby organizing the cable and reducing tangling of the cable. However, the neck strap of Rodolpho reference allows the mobile electronic device to swing annoyingly during vigorous movement of the user.

Another related reference is U.S. Pat. No. 5,680,977A filed by Jong-tae Lee et al. describes a strap for portable device. The Jong-tae reference discloses a holder strap for a portable device, and a fixation guider for guiding the strap through an inserting hole of the portable device in order to fix the strap at the portable device without using an additional commercial tool. The strap can be used to hang the portable device on a hand, a neck, a bag, a purse, or the like. The fixation guider can be readily inserted into the inserting hole of the portable device. The fixation guider for the strap includes a strap holding portion for enclosing and holding the strap therein, and a projection portion extending from the strap holding portion and configured to insert in the inserting hole of the portable device. However, the Jong-tae reference also lacks to prevent swinging of portable device during movement of the user.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a wearable holder configured to enable hands-free transport and usage of a portable device.

It is another object of the present invention to provide a multi-functional wearable holder configured to secure, transport and utilize one or more personal accessories and one or more portable devices.

It is yet another object of the present invention to provide a wearable holder adapted to be worn on wearer's neck, wearer's wrist, wearer's waist or wearer's body.

It is yet another object of the present invention to provide a wearable holder comprising a waist strap composed of a length of material having a first end and a second end, wherein the first end having a first fastening member and the second end having a second fastening member, wherein the first fastening member is reversibly or detachably fastened to the second fastening member.

It is yet another object of the present invention to provide the wearable holder comprising a middle strap composed of a length of material having a first end and a second end, wherein the first end of the middle strap having a third fastening member and the second end of the middle strap having a fourth fastening member, wherein the fourth fastening member is detachably attached to a fifth fastening member extending from the waist strap.

It is yet another object of the present invention to provide the wearable holder comprising a neck strap composed of a length of material having a first end and a second end, wherein the first end is configured to loop around the neck of the wearer and a second end having a sixth fastening member, wherein the third fastening member is detachably fastened to the sixth fastening member.

It is yet another object of the present invention to provide the wearable holder comprising a receptacle secured to the middle strap, which is adapted to receive the portable device.

It is yet another object of the present invention to provide one or more apertures on the receptacle through which headset or the like could be connected to the electronic device secured in the receptacle.

It is yet another object of the present invention to provide a first size adjusting member with the waist strap.

It is yet another object of the present invention to provide a second size adjusting member with the neck strap.

It is yet another object the present invention to provide a plurality of pockets on an interior side of the receptacle to secure one or more personal accessories.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
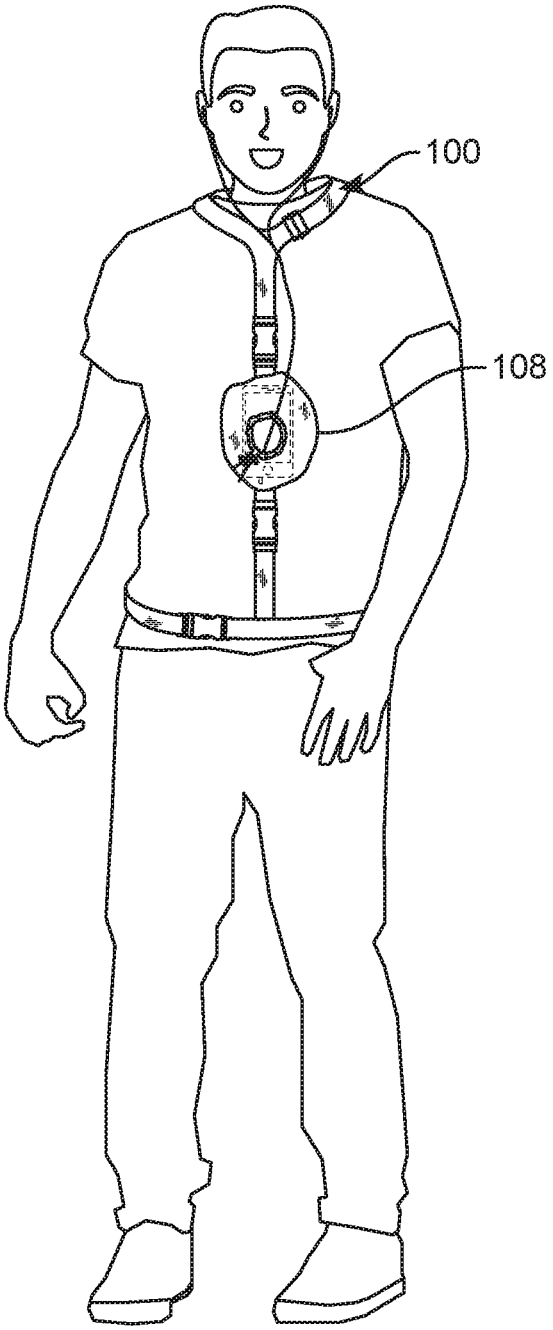
FIG. 1 exemplarily illustrates a wearer utilizing a wearable holder 100 for hands-free transport and usage of a portable device in an embodiment of the present invention. The wearable holder 100 comprising a receptacle 108 adapted to secure the portable device, is illustrated.
Figure 2:
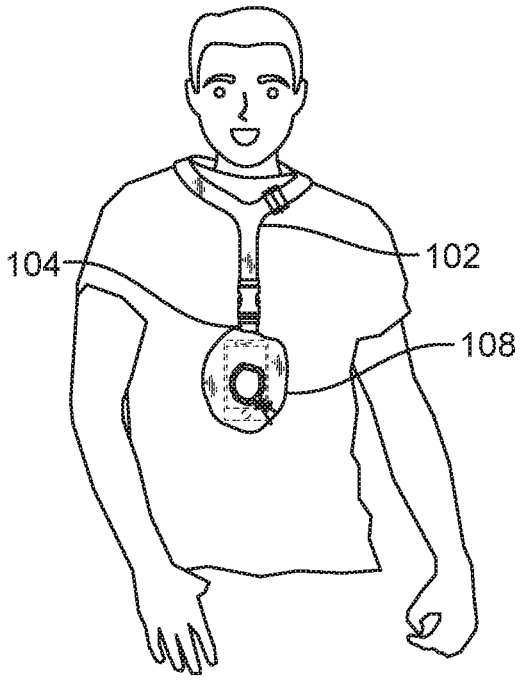
FIG. 2 exemplarily illustrates the wearable holder 100 worn on the wearer's neck in another embodiment of the present invention.
Figure 3:
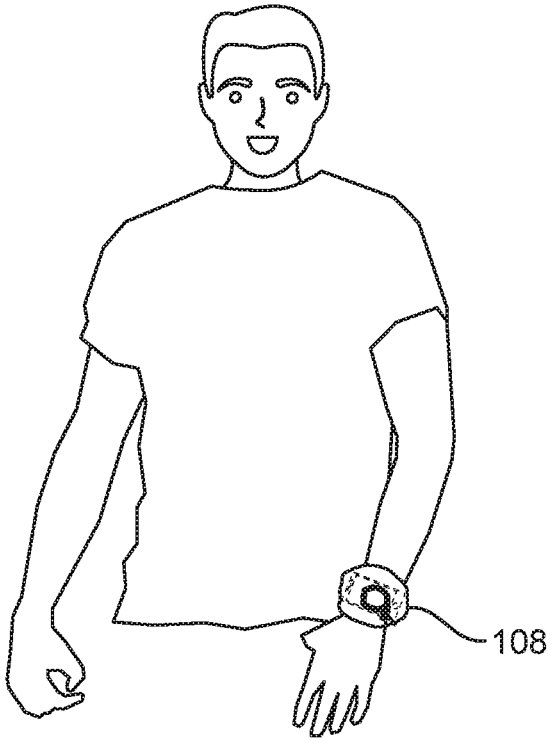
FIG. 3 exemplarily illustrates the wearable holder 100 worn on the wearer's wrist in another embodiment of the present invention.
Figure 4:
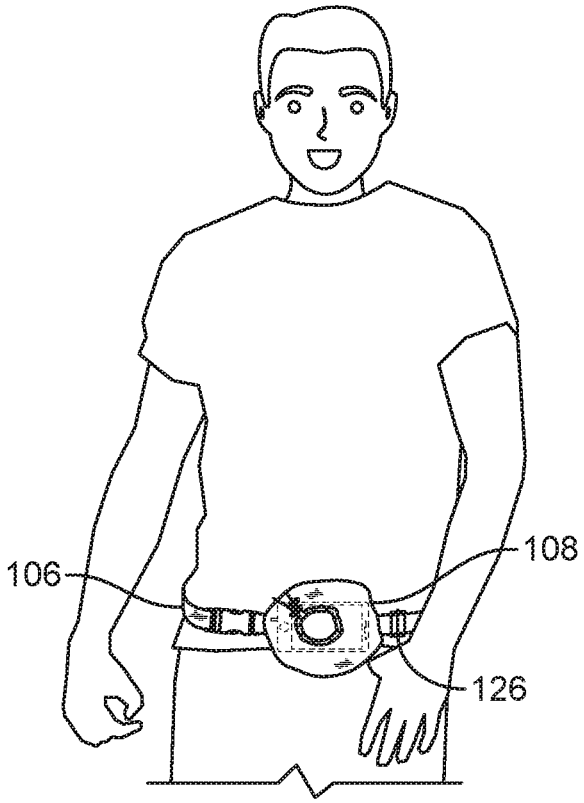
FIG. 4 exemplarily illustrates the wearable holder 100 worn on the wearer's waist in another embodiment of the present invention.
Figure 5:
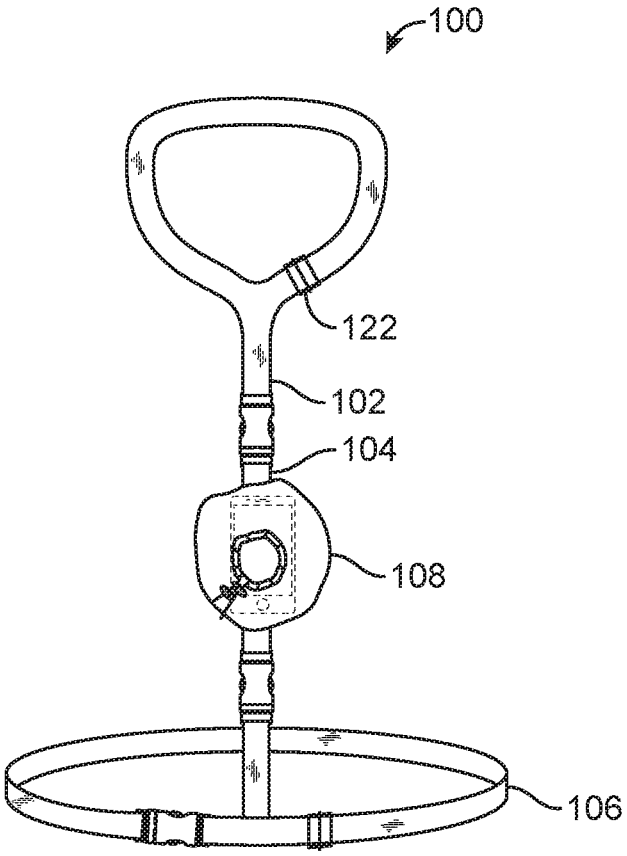
FIG. 5 exemplarily illustrates a perspective view of the wearable holder 100 in an embodiment of the present invention. The wearable holder 100 comprises a neck strap 102, a waist strap 106, a middle strap 104 and the receptacle 108, is illustrated.
Figure 6:
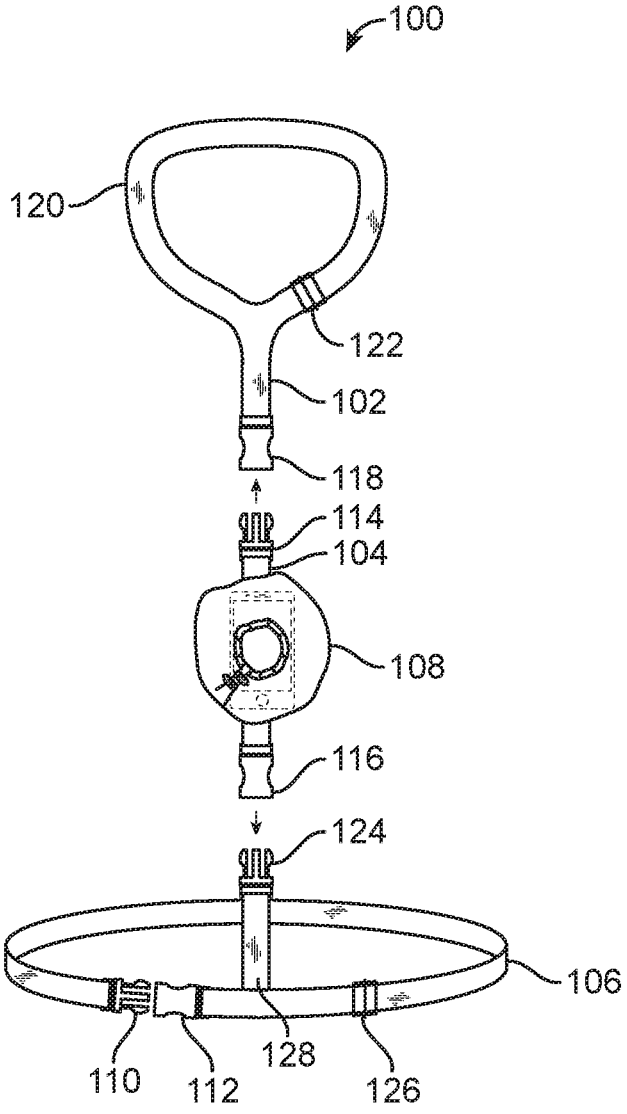
FIG. 6 exemplarily illustrates a disassembled wearable holder 100 in an embodiment of the present invention. The waist strap 106 adapted to secure to the waist of the wearer, the neck strap 102 adapted to loop around the neck of the wearer and the middle strap 104 disposed between the waist strap 106 and the neck strap 102, is illustrated.

Referring now to the drawings, FIGS. 1-6, where the present invention is generally referred with numeral 100, it can be observed that a wearable holder 100 configured to enable hands-free transport of electronic device is disclosed. The wearable holder or multi-functional wearable holder 100 is configured to enable both hands-free transport or usage of an electronic device. The wearable holder 100 is further configured to secure one or more personal accessories. The wearable holder 100 is adapted to be worn on wearer's neck, wearer's wrist, wearer's waist or wearer's body.

In one embodiment, the wearable holder 100 comprises a waist strap 106, a middle strap 104, a neck strap 102 and a receptacle 108. The waist strap 106 is composed of a length of material having a first end and a second end. In one embodiment, the first end of the waist strap 106 comprises a first fastening member 110 and the second end of the waist strap 106 comprises a second fastening member 112. In one embodiment, the first fastening member 110 is reversibly or detachably fastened to the second fastening member 112. In one embodiment, the waist strap 106 further comprises a first size adjusting member 126 to adjust the size of the waist strap 106.

The middle strap 104 is composed of a length of material having a first end and a second end. In one embodiment, the first end of the middle strap 104 comprises a third fastening member 114 and the second end of the middle strap 104 comprises a fourth fastening member 116. In another embodiment, the fourth fastening member 116 is detachably attached to a fifth fastening member 124. In one embodiment, the fifth fastening member 124 is disposed at one end of a strap 128 extending from the waist strap 106.

The neck strap 102 is composed of a length of material having a first end and a second end. In one embodiment, the first end of the middle strap 104 comprises a flexible loop 120 configured to extend around the neck of the wearer and the second end comprises a sixth fastening member 118. In one embodiment, the third fastening member 114 is detachably fastened to the sixth fastening member 118. In one embodiment, the flexible loop 120 is provided with a second size adjusting member 122 to vary the size of the flexible loop 120. In one embodiment, the first size adjusting member 126 and the second size adjusting member 122 is configured to enable a plurality of age groups or size groups of wearers to utilize the wearable holder 100.

In one embodiment, the first fastening member 110 and the second fastening member 112 is fastened by at least one of a buckling, snapping, or attaching type fastener. In one embodiment, the third fastening member 114 and the sixth fastening member 118 is fastened by at least one of a buckling, snapping, or attaching type fastener. In one embodiment, the fourth fastening member 116 and the fifth fastening member 124 is fastened by at least one of a buckling, snapping, or attaching type fastener In one embodiment, the receptacle 108 secured to the middle strap 104 is configured to secure at least one portable device. In one embodiment, the receptacle 108 is a drawstring type bag. In another embodiment, the receptacle 108 comprises at least one of a closure mechanism including, but not limited to zipper, button, buckle, hook and loop fastener, or strap, or by other conventional releasable closures. In another embodiment, the receptacle 108 comprises a plurality of pockets on an interior side to secure one or more personal accessories. In another embodiment, the receptacle 108 further comprises one or more apertures through which headset or the like could be connected to the electronic device secured in the receptacle 108.

In one embodiment, one or more pockets are disposed at a rear side of the receptacle 108. In one embodiment, the wearable holder 100 when worn as a neck strap without the waist strap 106, the fourth fastening member 116 is hidden into the pocket to provide a pleasant appearance. In another embodiment, one or more mechanism is provided at the rear side of the receptacle 108 to hide the the fourth fastening member 116. In one embodiment, the wearable holder 100 when worn as a waist strap, the third fastening member 114 of the middle strap 104 is detachably attached to the second fastening member 112 and the fourth fastening member 116 is detachably attached to the the first fastening member 110. Further, the fifth fastening member 124 is hidden at the length of material of the waist strap 106. In an alternative embodiment, one or more mechanism disposed at a rear side of the waist strap 106 to enable the user to hide the fifth fastening member 124, when the wearable holder 100 is worn on wearer's waist.

In another embodiment, the receptacle 108 is secured to at least any one of the middle strap 104, the waist strap 106 or the neck strap 102. In yet another embodiment, the receptacle 108 is detachably secured to at least any one of the middle strap 104, the waist strap 106 or the neck strap 102. In yet another embodiment, the receptacle 108 is made of semi-rigid material. In yet another embodiment, the receptacle 108 is made of a material to allow hand insertion of the portable device into an interior cavity of the receptacle 108 and could retain the inserted device in the interior of the receptacle 108.

Preferably, the electronic device is a smartphone or mobile phone. In some embodiments, the electronic device includes, but not limited to, personal data assistant, cellular telephone, pager, MP3 Player, media player, handheld game, handheld GPS device or any other personal accessory or hand-held device. In yet another embodiment, the receptacle 108 is made of waterproof material. In yet another embodiment, the rear side of the receptacle 108 is made of transparent material, which allow the user to easily view the stored personal accessories without accessing the interior of the receptacle 108. In one embodiment, the material includes, but not limited to, nylon. The material used for constructing the wearable holder 100 is available in a variety of colors, to provide the wearer with choices to suit individual taste.

Advantageously, the wearable holder 100 is easy and inexpensive to manufacture, and very durable. The wearable holder 100 provides a hand-free characteristic and stability of electronic device secured in the wearable holder 100. The wearable holder 100 prevents accidental dislodge of the electronic device from the user during activities, including but not limited to, sports activity, cleaning activity, exercising. The wearable holder 100 prevents accidental misplacement of the electronic device. Further, the wearable holder 100 prevents from dropping, slipping or falling of the electronic device from out of a pocket, a briefcase or one's hand. Further, the wearable holder 100 could be converted into a hand-held carrier. Further, the wearable holder 100 could be worn on wearer's arm or neck.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A wearable holder, comprising:

a waist strap composed of a length of material having a first end and a second end, wherein the first end having a first fastening member and the second end having a second fastening member, wherein the first fastening member is detachably fastened to the second fastening member;

a middle strap composed of a length of material having a first end and a second end, wherein the first end of the middle strap having a third fastening member and the second end of the middle strap having a fourth fastening member, wherein the fourth fastening member is detachably attached to a fifth fastening member extending from the waist strap;

a neck strap composed of a length of material having a first end and a second end, wherein the first end loops around the neck of a wearer and a second end having a sixth fastening member, wherein the third fastener is detachably fastened to the sixth fastening member, and a receptacle secured to the middle strap, said receptacle receiving a portable device therein, said receptacle being entirely above of said waist strap, said receptacle being centrally mounted on said middle strap, said receptacle including an opening, said opening being centrally located on a front portion of said receptacle.

2. The wearable holder of claim 1, wherein the receptacle includes a plurality of pockets on an interior side of the receptacle.

3. The wearable holder of claim 1, wherein the material is nylon.

4. The wearable holder of claim 1, wherein the receptacle is made of semi-rigid material.

5. The wearable holder of claim 1, wherein the first end of the neck strap is a flexible loop.

6. The wearable holder of claim 1, wherein the waist strap includes a first size adjusting member.

7. The wearable holder of claim 1, wherein the neck strap includes a second size adjusting member.

8. The wearable holder of claim 1, wherein the receptacle is a drawstring type bag.

9. The wearable holder of claim 1, utilizes at least one of a buckling, snapping, or attaching type fastener member.

10. The wearable holder of claim 1, wherein said first fastening member and said second fasting member being on a front side of said waist strap.

11. The wearable holder of claim 1, wherein said waist strap includes a waist strap width, said waist strap width being constant along an entire perimeter of said waist strap.

12. The wearable holder of claim 1, wherein said receptable being located between said waist strap and said neck strap.

13. The wearable holder of claim 1, wherein said middle strap has a middle strap length, said receptacle has a receptacle length, said middle strap length being greater than said receptacle length.

14. The wearable holder of claim 1, wherein said receptacle is parallel to said waist strap.

* * * * *